United States Patent [19]

Bogese, II

[11] 4,308,421

[45] Dec. 29, 1981

[54] EMF CONTROLLED MULTI-CONDUCTOR CABLE

[75] Inventor: Stephen B. Bogese, II, Roanoke, Va.

[73] Assignee: Virginia Plastics Company, Roanoke, Va.

[21] Appl. No.: 113,752

[22] Filed: Jan. 21, 1980

Related U.S. Application Data

[63] Continuation-in-part of Ser. No. 870,566, Jan. 18, 1978, Pat. No. 4,185,162.

[51] Int. Cl.[3] ..... H01B 7/08; H01B 11/08

[52] U.S. Cl. ..... 174/32; 174/115; 174/117 F

[58] Field of Search ..... 174/32, 36, 115, 117 R, 174/117 F, 117 FF, 113 R; 333/1, 84 R, 96, 236, 243

[56] References Cited

U.S. PATENT DOCUMENTS

| | | | |
|---|---|---|---|
| 2,471,752 | 5/1949 | Ingmanson | 174/117 R X |
| 3,179,904 | 4/1965 | Paulsen | 174/36 X |
| 3,219,752 | 11/1965 | Harris | 174/117 R |
| 3,408,453 | 10/1968 | Shelton, Jr. | 174/68.5 |
| 3,439,111 | 4/1969 | Miracle et al. | 174/107 |
| 3,459,879 | 8/1969 | Gerpheide | 174/117 FF |
| 3,576,723 | 4/1971 | Angele et al. | 174/36 X |
| 3,600,500 | 8/1971 | Schoerner et al. | 174/116 X |
| 3,663,739 | 5/1972 | Chevrier | 174/36 |
| 3,735,022 | 5/1973 | Estep | 174/117 F |
| 3,763,306 | 10/1973 | Marshall | 174/36 X |
| 3,775,552 | 11/1973 | Schumacher | 174/36 X |
| 3,800,065 | 3/1974 | Bunish et al. | 174/117 F X |
| 3,819,848 | 6/1974 | Fry | 174/117 F X |
| 3,833,755 | 9/1974 | Soelberg | 174/117 F |
| 3,865,972 | 2/1975 | Norris | 174/115 |
| 4,097,324 | 6/1978 | Emmel | 174/117 F X |
| 4,155,613 | 5/1979 | Brandeau | 174/36 X |

FOREIGN PATENT DOCUMENTS

| | | | |
|---|---|---|---|
| 697919 | 11/1964 | Canada | 174/117 F |
| 2547152 | 4/1977 | Fed. Rep. of Germany | 174/36 |
| 2036798 | 12/1970 | France | 174/117 F |
| 1390152 | 4/1975 | United Kingdom | 174/117 F |

*Primary Examiner*—Volodymyr Y. Mayewsky
*Attorney, Agent, or Firm*—Saidman & Sterne

[57] ABSTRACT

A multi-conductor transmission cable which includes a plurality of parallel conductors each of which may be insulated with a relatively low loss, high velocity of propagation material. The insulations surrounding an adjacent conductor pair may be joined by a homogeneous integrally formed EMF window web formed of the same material as the insulations. The thickness and length of the window webs are selected to control the electromagnetic interference between the conductor pair, as well as the impedance and capacitance. Individual, uninsulated screen conductors may be positioned between adjacent conductor pairs to further minimize EMF interference. The insulated conductors, their EMF window webs, and the uninsulated screen conductors may be encapsulated by either upper and lower layers of laminated insulation or by an extruded outer layer formed of a material having a velocity of propagation different from the conductors' insulations. The thickness of the outer laminated layers or extruded layer may also be varied between adjacent insulated conductors to further control EMF interference therebetween.

11 Claims, 19 Drawing Figures

EMF CONTROLLED MULTI-CONDUCTOR CABLE

CROSS-REFERENCE TO RELATED APPLICATION

This application is a continuation-in-part of my prior application Ser. No. 870,566, filed Jan. 18, 1978, now U.S. Pat. No. 4,185,162, issued Jan. 22, 1980.

BACKGROUND OF THE INVENTION

1. Field of the Invention

The present invention is related to transmission cables and, more particularly, is directed towards a multi-conductor transmission cable whose EMF properties may be precisely controlled, and particularly with respect to such cables intended for use in high speed communication systems and telephone systems.

2. Description of the Prior Art

It is well known that an electric current flowing through a conductor creates an electromagnetic field surrounding the conductor. The surrounding field can, in turn, induce a smaller electric current on other conductors located nearby. The induced current may either increase or decrease the signal magnitude on the adjacent conductor, and therefore can lead to signal errors.

Accordingly, signal bearing conductors are frequently insulated with a low loss material such as, for example, Teflon, which, because of its good dielectric properties, causes the electromagnetic field (EMF) of the conductor to cover a smaller area, thereby reducing the induced current effect of the insulated conductor.

In many communication systems, a conductor pair, known as a send conductor and a return conductor, are required for each signal to serve as either transmission verification or in order to provide system feedback. A common construction of conductor pairs utilizes two individually insulated conductors twisted together in such a fashion so that their respective EMF's are intended to largely cancel one another. In a large transmission cable, many sets of twisted pairs are aligned in a single plane between a pair of outer layers of usually laminated insulation.

A flat transmission cable configuration as above-described suffers from the deficiency that it is impossible to maintain intimate contact between the outer longitudinal layers of insulation and the individual insulations of the twisted pair of conductors. Air pockets are thereby trapped and, as the EMF travels through the air transition zones, the tendency is to distort the signal transmitted on the conductors which can lead to signal errors. Since the twisted insulated conductors vary in their center-to-center distance, the EMF cancellations also fluctuate.

To overcome the foregoing deficiencies, it is quite well known to replace twisted conductors pairs with substantially parllel multi-conductor cables in which the conductors are totally encapsulated in a substantially homogeneous low loss insulation material. While eliminating the problem of signal distortion resulting from trapped air zones, most of the presently available flat cable designs still suffer from one or more disadvantages.

One of the disadvantages of present flat cable designs still results from uncontrollable EMF interference between adjacent conductors. Despite the elimination of the air pocket problem, control of EMF interference remains difficult.

Further, with the advent of faster computer speeds, higher data transmission rates between computer components and peripherals are required so as to minimize delays caused by waiting for information transfer. Another general problem, therefore, with presently available multi-conductor cables is their slow velocity of propagation rates. Present day cables also fail to make any provision for different signal transmission speeds within a single cable.

A further deficiency relates to excessive cost of manufacturing such cables. The extremely low loss, low dielectric constant, high velocity of propagation insulation material is relatively expensive compared to the more lossy, low velocity of propagation polymers. An efficient multiconductor cable design would therefore utilize the low dielectric constant material to the minimum extent necessary to achieve the desired cable characteristics. It may be appreciated that in mass production of such cables, if it were possible to replace even a small amount of the low dielectric constant material with a higher dielectric constant material, tremendous savings in manufacturing costs would be achieved. Many present cable designs, unfortunately, use the expensive polymers unnecessarily and wastefully over the signal conductors as well as the ground conductors.

U.S. Pat. No. 3,763,306 to Marshall exemplifies a multi-layer flat cable design wherein the ground conductors (which do not require a high propagation velocity) are embedded in the same layer and material as the signal conductors. This means that more expensive material with good properties is used around the ground conductors than is necessary, which results in a higher cable cost. Further, the material covering all the conductors has a fixed thickness which can allow uncontrolled EMF interference to bypass the ground conductors and induce false pulses on the adjacent signal conductors.

In U.S. Pat. No. 3,459,879, Gerpheide illustrates a two layer multi-conductor cable construction in which the ground conductors and the signal conductors are embedded in each layer in the same insulating material. Such a construction has the same drawbacks as set forth above with respect to the Marshall design. In addition, in order to eliminate interference, Gerpheide positions the ground conductors of one layer opposite the signal conductors of the other layer to form a triad of ground conductors around each signal conductor. Clearly, the provision of two layers, each with extra conductors, results in a far greater cost than would otherwise be necessary. The construction illustrated in U.S. Pat. No. 3,179,904 to Paulsen is similar.

Multi-conductor transmission line cables are also known which utilize a homogeneous Teflon insulation over both the signal and ground conductors. Such a construction provides a very high propagation velocity, but utilizes the expensive Teflon insulator unnecessarily around the ground conductors.

U.S. Pat. No. 3,735,022 to Estep provides a partial solution to the shortcomings outlined above in teaching a multi-conductor cable design in which signal conductor pairs are first extruded in a low dielectric constant material, such as polyethylene or foam, and the extruded conductor pairs are then extruded once again in a jacket which consists of a lossy dielectric material, such as vinyl. The design of Estep eliminates circumferential air present in prior art twisted pair designs to reduce excess crosstalk, but nevertheless presents several difficulties of its own. Initially, no provision is made in Estep for controlling, to any desired degree, the amount of EMF interference between embedded conductor pairs. Additionally, Estep's design fails to take into account impedance and capacitance effects between adjacent conductors. That is, while it is frequently desirable to reduce cross-interference between conductor pairs as much as possible, other factors and parameters may require designs which permit the amount of EMF interference between the conductor pairs to be varied. Such factors include, for example, the capacitance between the conductors and the impedance of the cable, and are generally a function of relationship between the two conductors to each other, including the amount of insulation contained between them, the dielectric properties of the insulation, the distance between the wires, and the like. In high speed signal communication cables, it is important to be able to achieve the desired capacitance and impedance, while still achieving a certain EMF cancellation.

The Estep construction specifies a conductor insulation having a rectangular, ellipsoid or circular cross-section, while the outer jacket is of generally rectangular cross-section. Such a construction is quite disadvantageous in terms of ease of termination of the cable. The circular, ellipsoid, or rectangular cross-sections contain two or more conductors with no clearly defined individual inner walls between them. As a result, it is extremely difficult to precisely locate and separate one conductor from the other conductor of a pair and obtain a flawless, uniform insulation layer around each conductor. Therefore, perfect connector termination is rarely attained and is very time-consuming to attempt. Further, an imperfectly terminated cable could result in field failures which cannot be detected at the time of termination.

Similar problems arise in connection with telephone cables in which at least one pair of adjacent conductors are normally utilized to carry high voltage. The EMF generated by such high voltage conductors must be controlled in order to prevent interference to adjacent signal-carrying conductors as well as to sensitive electronic components which may be located in close proximity to the terminated end of such a cable.

Other patents of which I am aware which relate to multi-conductor cables include: U.S. Pat. Nos. 2,471,752; 3,219,752; 3,408,453; 3,439,111; 3,576,723; 3,600,500; 3,775,552; 3,800,065; 3,819,848; 3,833,755; and 3,865,972; French Pat. No. 2,036,798; British Pat. No. 1,390,152; and Canadian Pat. No. 697,919.

OBJECTS AND SUMMARY OF THE INVENTION

It is therefore a primary object of the present invention to provide a multi-conductor cable wherein the signal conductors are insulated by a low loss, low dielectric constant material, and wherein electromagnetic field interference between adjacent signal conductor pairs may be precisely controlled.

A general object of the present invention is to provide a multi-conductor transmission cable which overcomes all of the deficiencies noted above with respect to prior art designs.

An additional object of the present invention is to provide an inexpensive, versatile, and efficient multi-conductor cable design which may either minimize or maximize adjacent conductor EMF interference, ad desired.

A further object of the present invention is to provide a flat multi-conductor transmission cable which minimizes the utilization of high propagation velocity, low loss insulation material so as to maximize efficiency and minimize production costs.

A still further object of the present invention is to provide a multi-conductor communication cable wherein the signal conductors are insulated by a low loss insulator, and the insulated signal conductors are maintained in a precise spatial relationship by an outer, laminated or extruded relatively high dielectric constant material.

A still further object of the present invention is to provide a multi-conductor transmission cable which permits selection of different signal propagation velocities within one cable so as to permit customized cable design for any desired application.

A still additional object of the present invention is to provide a multi-conductor flat transmission cable in which the conductors are precisely spaced and easily located to permit rapid termination thereof with insulation displacement or insulation piercing connectors.

The foregoing and other objects are attained in accordance with one aspect of the present invention through the provision of a multi-conductor cable which comprises a plurality of parallel conductors each enclosed by an insulation having a first velocity of propagation, each such insulated conductor having a substantially circular uniform cross-section along its length. Means are provided for encapsulating the plurality of insulated conductors in a fixed spaced relationship and is comprised of a material with a second velocity of propagation different than the first velocity of propagation. The encapsulating means includes substantially parallel opposed outer surfaces having portions located adjacent the insulated conductors and portions located intermediate the insulated conductors. Means are also preferably provided for controlling the electromagnetic field interaction between adjacent insulated conductors which comprises the portions of the encapsulating means located intermediate the insulated conductors.

In accordance with a more specific aspect of the present invention, the plurality of insulated conductors includes first, second and third insulated conductors which are arranged substantially in a plane. The portion of the encapsulating means located intermediate the first and second insulated conductors has, in one embodiment, an overall thickness less than that of the portions located adjacent the first and second conductors for providing EMF isolation between the first and second insulated conductors. The portion of the encapsulating means located intermediate the second and third insulated conductors has an overall thickness greater than that of the portion located intermediate the first and second insulated conductors for providing less EMF isolation between the second and third insulated conductors than that between the first and second insulated conductors. More particularly, the overall thickness of the portion of the encapsulating means located intermediate the second and third conductors is substantially the same as that of the portion located adjacent the second and third insulated conductors. In an alternate embodiment, the portion of the encapsulating means located intermediate the second and third insulated conductors has an overall thickness substantially the same as that portion located intermediate the first and second insulated conductors.

In accordance with another aspect of the present invention, at least two uninsulated screen conductors may be respectively positioned intermediate the first and second insulated conductors and the second and third insulated conductors within the portions of the encapsulating means located intermediate same, respectively.

In accordance with another aspect of the present invention, the plurality of insulated conductors may include first and second pairs of insulated conductors arranged substantially in a plane. The portion of the encapsulating means located intermediate the first and second pairs of insulated conductors has an overall thickness less than that of the portions located adjacent the first and second pairs of conductors for providing EMF isolation between the first and second pairs of insulted conductors.

In accordance with a further aspect of this embodiment, a third pair of insulated conductors may be arranged coplanar with the first and second pairs, and the portion of the encapsulating means located intermediate the second and third pairs of insulated conductors has an overall thickness substantially the same as that portion located intermediate the first and second pairs of insulated conductors. At least two uninsulated screen conductors may also be provided which are respectively positioned intermediate the first and second pairs of insulated conductors and the second and third pairs of insulated conductors within the portions of the encapsulating means located intermediate same, respectively.

In accordance with yet another aspect of the present invention, a substantially planar EMF window web may extend between adjacent insulated conductors and may be formed integrally with the insulation that encloses the adjacent insulated conductors, the thickness of the web being less than the outer diameter of the insulation. In accordance with a further embodiment, first and second additional insulated conductors may be provided which are coplanar with the adjacent insulated conductors, and the first and second additional conductors may be positioned next to one another and may include an additional integrally formed substantially planar EMF window web connecting the respective insulations thereof.

In accordance with another aspect of this embodiment, further additional insulated conductors may be provided which are coplanar with the other insulated conductors, and a third pair of insulated conductors joined by an integral EMF window web may also be positioned coplanar with the individual insulted conductors.

In accordance with still another aspect of the present invention, the first and second additional insulated conductors may be positioned one on each side of the adjacent insulated conductors, and means for controlling the electromagnetic field interaction between the adjacent insulated conductors and the first and second additional insulated conductors may be provided which comprises the portions of the encapsulating means located intermediate the insulated conductors. The portion of encapsulating means located intermediate the first additional insulated conductor and the adjacent insulated conductors has an overall thickness less than that of the portions located adjacent the insulated conductors. More particularly, the overall thickness of the portion of the encapsulating means located intermediate the second additional conductor and the adjacent insulated conductors may be substantially the same as that of the portion located between the first additional insulated conductor and the adjacent insulated conductors.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1:
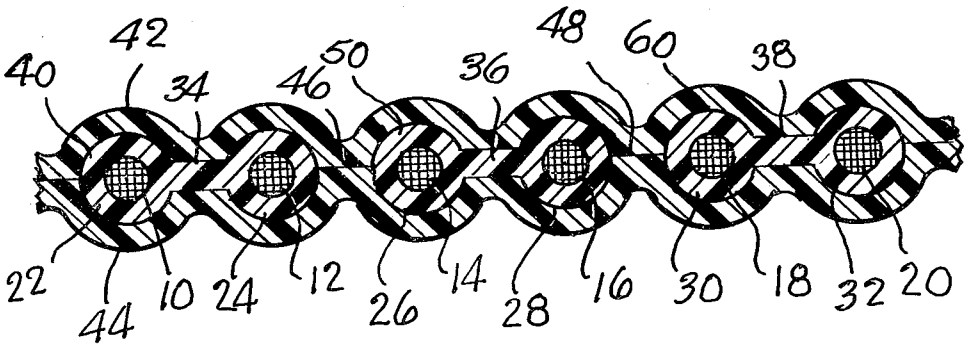
FIG. 1 is a cross-sectional view which illustrates one preferred embodiment of a multi-conductor transmission cable in accordance with the present invention.

Referring now to the drawings, wherein like reference numerals represent identical or corresponding parts throughout the several views, and more particularly to FIG. 1 thereof, a cross-section of one embodiment of a multi-conductor transmission cable is illustrated and is seen to comprise a plurality of elongated, parallel conductors 10, 12, 14, 16, 18 and 20.

The conductors 10, 12, 14, 16, 18 and 20 each may be an individual wire, or a multi-strand wire, each intended to carry but a single signal. The conductors 10 through 20 are each located in a single plane, and the cable of this embodiment is designed for use in high speed data communications where a high velocity of signal propagation is an important factor, as is careful control of EMF interference. To this end, the conductors 10 through 20 are arranged in conductor pairs 40, 50 and 60. Conductor pair 40 includes conductors 10 and 12, conductor pair 50 includes conductors 14 and 16, while conductor pair 60 includes conductors 18 and 20. Each of the conductor pairs 40, 50 and 60 may be said to include a send conductor and a return conductor, in a fashion analogous to the prior art twisted pair configurations.

Enclosing each of the conductors 10 through 20 is an insulation material which is preferably a high velocity of propagation, low loss, low dielectric constant material. Fluoropolymers are widely used as such insulators, and the fluoropolymer Teflon in particular provides an extremely low loss, high velocity propagation material suitable for high speed data communications. Insulating portions 22, 24, 26, 30 and 32 respectively enclose conductors 10, 12, 14, 16, 18 and 20, and are uniformly circular in cross-section along the entire length of the cable.

Extending between and integrally formed with the insulators 22 and 24 is a preferably substantially planar EMF window web 34, which is preferably extruded at the same time as insulators 22 and 24 about conductors 10 and 12. EMF window web 34 along with insulators 22 and 24 and conductors 10 and 12 form a signal conductor group 40. Importantly, the EMF window web 34, while being integrally joined and formed with the conductor insulations 22 and 24, may have a thickness and length which is independent of the thickness of the conductor insulators 22 and 24.

In particular preferred embodiment illustrated in FIG. 1, conductor insulators 26 and 28 are also joined by an integral, homogeneous EMF window web 36, and conductor insulators 30 and 32 are likewise joined by an EMF window web 38.

The window webs 34, 36 and 38, with their associated conductor insulators and signal conductors, in FIG. 1 form three signal conductor pair groups 40, 50 and 60. The groups 40, 50 and 60 are held in a precise, desired spatial relationship by an upper layer 42 and a lower layer 44 of additional insulation. The upper and lower layers 42 and 44 are preferably comprised of a material which has a velocity of propagation which is different, generally lower, than that of the conductor insulators 22 through 32. The lower velocity of propagation, high dielectric constant outer layers 42 and 44 may, for example, comprise polyvinylchloride (PVC), Polyester, ETFE (e.g., Tefzel ®), or ECTFE (e.g., Halar ®). The outer layers 42 and 44 are preferably laminated so as to maintain intimate contact between the outer surfaces of signal conductor groups 40, 50 and 60, as well as to ensure intimate contact with one another in those areas between adjacent conductor groups, denoted by reference numerals 46 and 48 in FIG. 1. Alternately, outer layers 42 and 44 may comprise a single piece of extruded material, as is well known in the art.

The EMF window webs 34, 36 and 38 provide means for allowing a precise and selectable amount of the EMF from both conductors within each group to field cancel one another. Much of the non-cancelled EMF is dissipated through the medium-to-low velocity of propagation outer layers 42 and 44. The cross-section of the cable is identical along its entire length, and therefore the longitudinally applied outer layers 42 and 44 may maintain complete and intimate contact with all conductor insulators and EMF window webs. As compared with twisted pair conductors, the design of FIG. 1 eliminates signal-distorting air pockets, and the window webs 34, 36 and 38 provide a precise control of conductor pair spacing. Note that no window webs join conductor pair groups 40, 50 and 60 to achieve a minimum level of interference to provide maximum isolation between adjacent conductor groups. The outer layers 42 and 44 thereby completely encapsulate the conductor groups 40, 50 and 60 to provide a substantial EMF reduction by dissipating the fields.

The outer layers 42 and 44 are of preferably uniform thickness so as to conform to the outer periphery of the conductor pair groups 40, 50 and 60. Owing to the circular cross-section of the insulated conductors, the outer layers 42 and 44 provide a readily visibile indication of the location of the conductors to facilitate and provide accurate connector termination of the cable.

Figure 2:
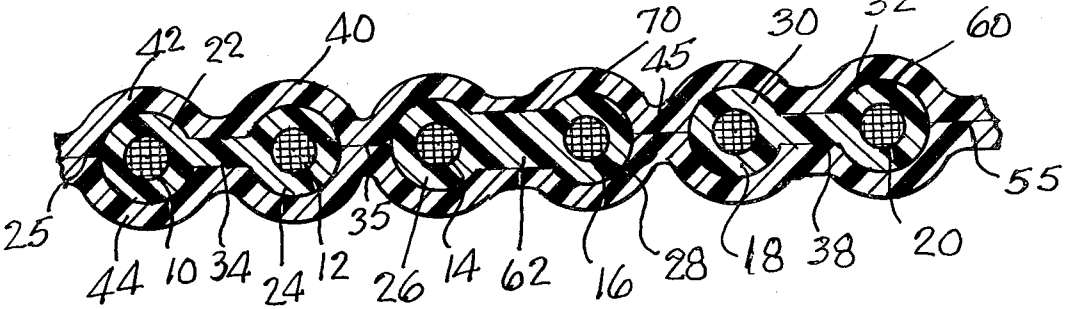
FIG. 2 is a cross-sectional view of an alternative preferred embodiment of the present invention.

Referring now to FIG. 2, there is illustrated an alternative preferred embodiment of a cable construction in accordance with the present invention which includes conductors 10, 12, 14, 16 and 18 and 20. Each of the conductors 10 through 20 is again insulated with a high velocity of propagation, low loss material, such as Teflon, as indicated by reference numerals 22, 24, 26, 28, 30 and 32. Between adjacent conductor pairs 10–12, 14–16 and 18–20 are again positioned homogeneous, integrally formed and connecting EMF window webs 34, 62 and 38. The window webs and associated conductors and insulators again form three signal conductor pair groups indicated by reference numerals 40, 60 and 70. The preferred embodiment illustrated in FIG. 2 illustrates the utilization of window webs having differing thicknesses. For example, webs 34 and 38 may have a thickness of approximately 0.010 inch which permits a relatively small amount of EMF cross-cancellation to occur between conductor pairs 10–12 and 18–20, respectively. In contrast, EMF window web 62 may have a thickness on the order of approximately 0.025 inch which permits a relatively greater degree of EMF cross-cancellation to occur between conductors 14 and 16. This may be useful, for example, where conductor pair group 70 is utilized for a higher speed communications transmission, and it is therefore necessary to ensure a greater degree of EMF cross-cancellation than is necessary, for example, with signal pair conductor groups 40 and 60. Other factors affecting the desired thickness and length of the EMF window webs include the desired capacitance and impedance of the conductors and cable and the like. Narrowing of the window webs, as at 34 and 38, while leading to less EMF cross-cancellation, may nevertheless offer othermore desirable operating parameters, while still maintaining crosstalk at a somewhat higher but acceptable level for certain applications.

In FIG. 2, the contour hugging outer layers 42 and 44, preferably comprised of lower velocity of propagation materials, eliminate signal-distorting air pockets, and yet permit the desired degree of EMF cross-cancellation to occur through the preformed window webs. Reduced EMF between unrelated conductor groups 40, 70 and 60 is accomplished by virtue of the outer layers 42 and 44 contacting themselves, as indicated by reference numerals 25, 35, 45 and 55, thereby dissipating any stray fields.

Figure 3:
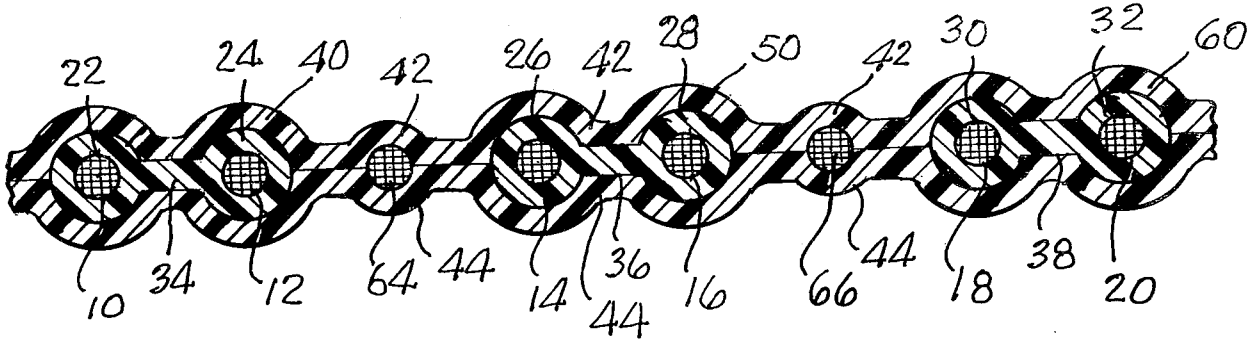
FIG. 3 is a cross-sectional view which illustrates yet another alternative embodiment of a transmission cable according to the present invention.

FIG. 3 illustrates yet another alternative embodiment of the present invention which includes identical signal conductor pair groups 40, 50 and 60 and outer laminated layers 42 and 44 as in the embodiment of FIG. 1. However, the embodiment of FIG. 3 provides even greater improvement in EMF control between adjacent conductor groups 40, 50 and 60 by the provision of uninsulated screen conductors 64 and 66. Screen conductor 64 is placed intermediate signal conductor pair groups 40 and 50, while screen conductor 66 is placed intermediate signal conductor pair groups 50 and 60. The uninsulated screen conductors 64 and 66 are intimately encapsulated by the outer layers 42 and 44. The screen conductors 64 and 66 provides EMF absorption, in addition to the EMF dissipation which accrues by virtue of the outer layers 42 and 44. Accordingly, the design of FIG. 3 may be utilized in those special applications where EMF isolation between adjacent signal conductor groups is critical.

Note with respect to FIG. 3 that the relatively expensive, low dielectric constant, low loss, insulater material is utilized only about the signal-carrying conductors 10 through 20, as well as the field controlling EMF window webs 34, 36 and 38. None of the expensive insulator is utilized about the screen conductors 64 and 66 which provides an economical product. The only material adjacent the screen conductors 64 and 66 are the outer layers 42 and 44 which are of uniform thickness along their length, which also minimizes material waste.

Figure 4:
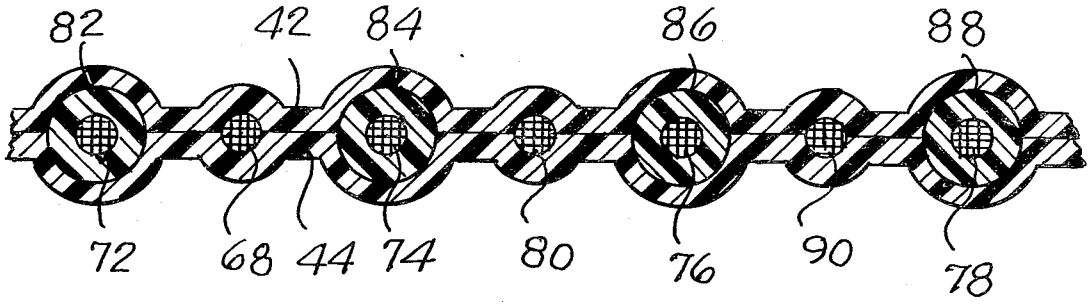
FIG. 4 illustrates still another alternate embodiment of a transmission cable having multiple conductors in accordance with the teachings of the present invention.

FIG. 4 illustrates an alternative embodiment of the present invention, and may be thought of as a special case wherein no EMF cross-cancellation is desired between conductors and maximum isolation is required. This is achieved by having EMF window webs of zero thickness between such conductors. Illustrated in FIG. 4 are four conductors 72, 74, 76 and 78, each of which include a low dielectric constant insulator 82, 84, 86 and 88, respectively. Positioned between the adjacent conductors 72 through 78 are uninsulated screen conductors 68, 80 and 90, while the outer layers 42 and 44 of lossy, relatively high dielectric constant lamination serves to position the insulated signal conductors and uninsulated screen conductors in a precise spatial relationship. The design of FIG. 4 is, for example, particularly well suited for extremely high speed transmission between computer components where transmission is uni-directional, and therefore does not require a return conductor. Each of the conductors 72, 74, 76 and 78 are isolated between one another by virtue of their surrounding low loss insulation and the interposed screen conductors 68, 80 and 90.

Figure 5:
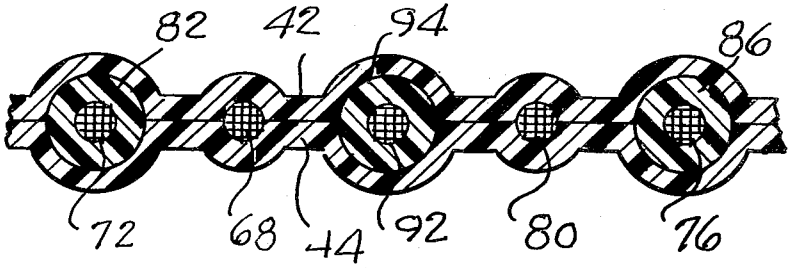
FIG. 5 is a cross-sectional view of still another alternate embodiment of the present invention.

Referring now to FIG. 5, an alternate embodiment of the present invention is illustrated which is basically a variation of the embodiment of FIG. 4. In FIG. 5, two conductors 72 and 76 are insulated with an extremely low loss, high velocity of propagation of material 82 and 86, such as Teflon. Conductor 92, on the other hand, is encased by a polyolefin insulation 94, so as to provide a moderately high velocity of propagation for conductor 92 without incurring the high cost of, for example, Teflon. Interposed between adjacent conductors 72 and 92 is an uninsulated screen conductor 68, while an uninsulated screen conductor 80 separates insulated conductors 92 and 76. All of the onductors are intimately encapsulated by the relatively lossy outer layers 42 and 44 as in the previous embodiments.

The construction of FIG. 5 is designed to provide various transmission speeds within a single cable. This permits several devices having different response times to be handled through a single interconnect cable. All conductors are isolated from one another and have uninsulated screen conductors to further reduce any adjacent EMF signal distortion.

Figure 6:
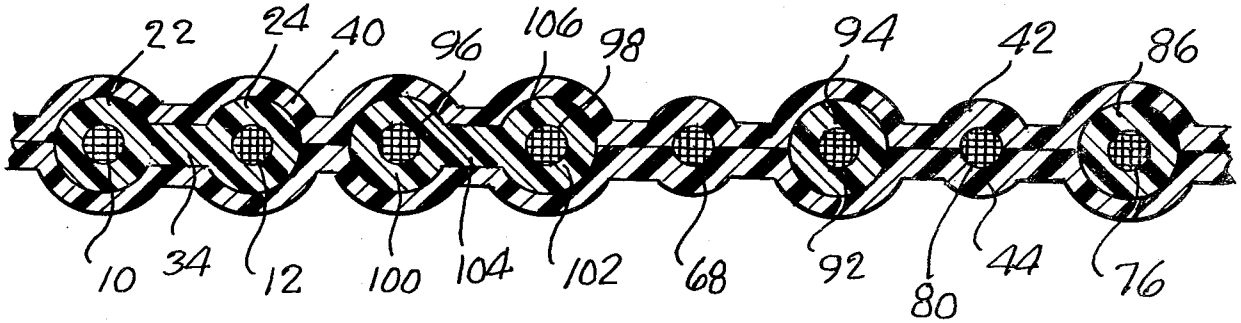
FIG. 6 is a cross-sectional view of yet another alternative preferred embodiment of a multi-conductor communication cable in accordance with the teachings of the present invention.

Referring now to FIG. 6, there is illustrated another possible embodiment which incorporates several of the features described above with respect to FIGS. 1 through 5 in a single multi-mode multi-use communication cable. Six conductors 10, 12, 96, 98, 92 and 76 are illustrated, each having an associated low dielectric constant, high velocity of propagation insulator 22, 24, 100, 102, 94 and 86, respectively. Insulators 22 and 24 are preferably comprised of Teflon for maximum velocity of propagation, as is the integral, homogeneous EMF window web 34 connecting insulators 22 and 24.

Insulators 100 and 102 may, for example, comprise ETFE with an integral EMF window web 104 positioned therebetween. ETFE has a somewhat lower velocity of propagation and higher dielectric constant than Teflon, and accordingly the signal carrying characteristics of conductors 96 and 98 will differ somewhat from those of conductors 10 and 12.

Conductor 92 may be provided with a polyolefin insulation 94 to provide yet another distinct signal carrying characteristic within the cable. Insulation 86 for signal conductor 76 may be comprised of Teflon.

Interposed between signal conductor pair group 106 and conductor 92 is an uninsulated screen conductor 68, and an uninsulated screen conductor 80 is positioned between conductors 92 and 76. Maximum isolation is therefore achieved between conductor group 106 and conductor 92, as is between conductors 92 and 76. A certain degree of EMF cross-cancellation will be permitted by EMF window web 34 in the signal conductor group 40, while a certain degree will be permitted in group 106, depending upon the precise length and thickness of the EMF window webs 34 and 104, respectively.

Figure 7:
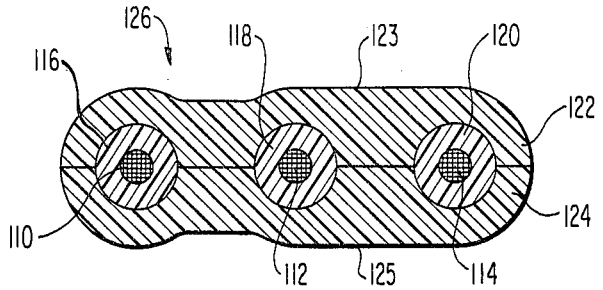
FIG. 7 is a cross-sectional view of yet another alternate embodiment of a multi-conductor communication cable of the present invention.

Referring now to FIG. 7, there is illustrated yet another alternate embodiment of a high speed communication cable in accordance with the present invention. Coplanar conductors 110, 112 and 114 are each surrounded by a low loss insulation 116, 118 and 120. The coplanar insulated conductors are held in a precise spatial relationship by upper and lower layers 122 and 124 of a laminated, high dielectric constant material. Alternatively, layers 122 and 124 may consist of a single extrusion, as is well known in the art. Layers 122 and 124 are characterized by opposed, substantially parallel outer surfaces 123 and 125.

In FIG. 7, it is desired to isolate the signal on conductor 110 from the signal on conductor 112 to a greater degree than the isolation desired between the signals on conductors 112 and 114, respectively. In lieu of providing an integral EMF window web between insulations 116 and 118, the outer layers 122 and 124 of insulation are provided with a reduced thickness portion 126 located intermediate insulated conductors 110 and 112. The reduced thickness portion 126 may be thought of as a non-integral EMF window web which permits a small amount of EMF cross-cancellation to occur between conductors 110 and 112, thereby providing greater isolation therebetween. Note that the portion of the layers 122 and 124 located intermediate conductors 112 and 114 has a greater overall thickness than portion 126, thereby permitting a greater amount of EMF cross-cancellation to occur between the signals on conductors 112 and 114. In other words, conductors 112 and 114 are less isolated from one another than are conductors 110 and 112. In the illustrated embodiment, the overall thickness of the outer encapsulating layers 122 and 124 between conductors 112 and 114 is equal to the overall thickness of such layers immediately adjacent conductors 112 and 114, which provides smooth, parallel outer surfaces 123 and 125.

Figure 8:
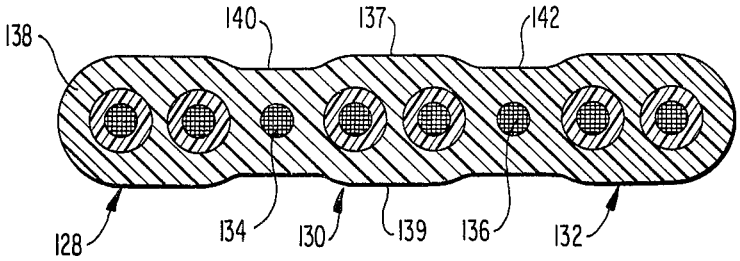
FIG. 8 is a cross-sectional view of another alternate embodiment of the present invention.

Referring now to FIG. 8, there are illustrated three insulated conductor pairs 128, 130 and 132. Positioned between pairs 128 and 130 is an uninsulated screen conductor 134, while positioned between pairs 130 and 132 is another uninsulated screen conductor 136. Insulated conductor pairs 128, 130 and 132 as well as screen conductors 134 and 136, are maintained in parallel alignment by a single extruded outer encapsulation 138 having substantially parallel opposed outer surfaces 137 and 139. Extrusion 138 includes a reduced thickness web 140 positioned intermediate conductor pairs 128 and 130, and another reduced thickness web 142 positioned intermediate conductor pairs 130 and 132. The reduced thickness portions 140 and 142 serve to isolate the EMF interference between adjacent conductor pairs 128, 130 and 132, as well as provide an indication of the location of the insulated conductors for facilitating termination of the cable. Although the relative overall thicknesses of portions 140 and 142 may be varied to suit the particular application, in a typical embodiment they may be, for example, 0.025 inch thick, while the overall thickness of the extrusion 138 immediately adjacent any of the conductor pairs 128, 130 and 132 may be, for example, 0.030 inch.

Figure 9:
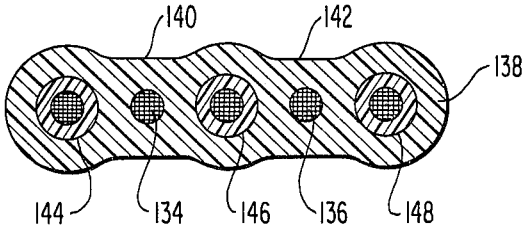
FIG. 9 is a cross-sectional view of a still further alternate embodiment of the present invention.

Referring now to FIG. 9, there is illustrated an alternate embodiment wherein single insulated conductors 144, 146 and 148 are positioned within an extrusion 138, and uninsulated screen conductors 134 and 136 are positioned intermediate the individual insulated conductors. Extrusion 138 is provided with a pair of reduced thickness webs 140 and 142 which are also positioned intermediate the respective insulated conductors 144, 146 and 148. This minimizes and serves to isolate the EMF emanating from insulated conductors 144, 146 and 148 from one another, and the screen conductors 134 and 136 to further isolate same by absorbing stray EMFs.

Figure 10:
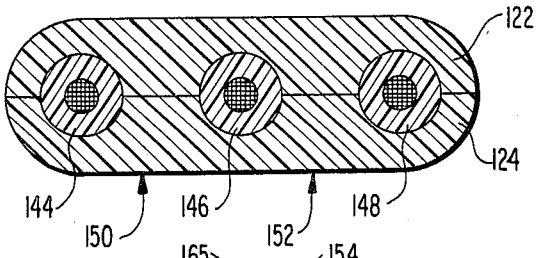
FIG. 10 is a cross-sectional view of a still further alternate embodiment.

Referring now to FIG. 10, there is illustrated a cross-section of a simplified version of a multi-conductor telephone cable which includes single insulated conductors 144, 146 and 148 positioned in a parallel, spaced manner within outer laminations 122 and 124. The portions 150 and 152 of laminations 122 and 124 located intermediate insulated conductors 144, 146 and 148 are of increased thickness (compared to FIG. 9) which provides less isolation than would be provided for the embodiment of FIG. 9, for example. In the illustrated embodiment of FIG. 10, the portions 150 and 152 have an overall thickness which is substantially the same as the overall thickness of laminations 122 and 124 immediately adjacent the insulated conductors 144, 146 and 148.

Figure 11:
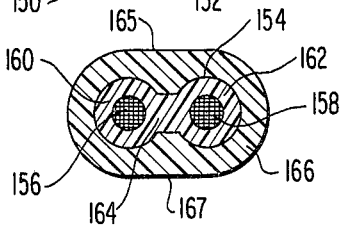
FIG. 11 is a cross-sectional view of a multi-conductor telephone cable in accordance with the teachings of the present invention.

Referring now to FIG. 11, there is illustrated a cross-section of a single high voltage conductor pair 154 as may be found in a typical multi-conductor telephone cable. Conductors 156 and 158 are adapted to carry relatively high voltages, and are surrounded by a low loss insulation 160 and 162, respectively. An integrally formed EMF window web 164 extends between insulations 160 and 162, and conductor pair 154 is then extruded in an outer encapsulation 166 which has substantially parallel opposed outer faces 165 and 167. The EMF cross-cancellation provided by window web 164 serves to minimize stray fields emanating from conductors 156 and 158 so as to reduce potential interference on any sensitive electronic components which may be located in proximity to the cable, especially, for example, at the point of termination thereof.

Figure 12:
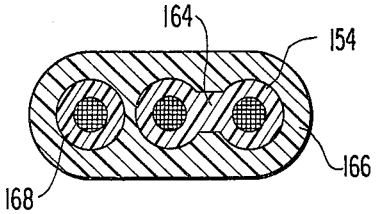
FIG. 12 is an alternate embodiment of the cable of FIG. 11.

Referring now to FIG. 12, there is illustrated another embodiment of the present invention wherein an insulated conductor 168 is positioned adjacent to and in planar alignment with high voltage conductor pair 154. Insulated conductor 168 may carry, for example, a low-level information-bearing signal, and it is desired to isolate stray fields from high voltage conductor pair 154 from insulated conductor 168 as much as possible. This function is achieved to a certain degree by provision of EMF window web 164.

Figure 13:
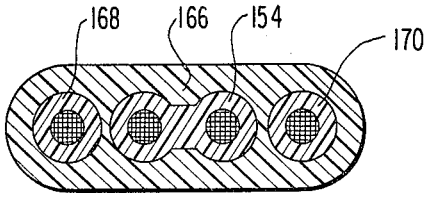
FIG. 13 is yet another alternate embodiment of a telephone cable in accordance with the present invention.

Referring now to FIG. 13, an alternate embodiment of the version of the present invention just described is illustrated and is seen to include an additional signal-carrying insulated conductor 170 which is positioned on the opposite side of high voltage conductor pair 154. Again, this construction reduces any EMFs from the high voltage signals on the conductors of pair 154 from interfering with the information on insulated conductors 168 and 170.

Figure 14:
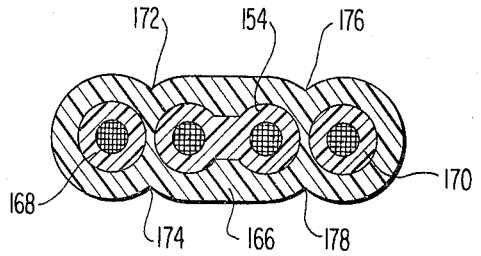
FIG. 14 is a cross-sectional view of a further alternate embodiment of a cable of the present invention.

FIG. 14 is a modified version of FIG. 13 and is seen to include a first reduced thickness portion which includes indented areas 172 and 174 of extrusion 166 positioned between insulated conductor 168 and conductor pair 154, and a second reduced thickness portion which includes indented portions 176 and 178 of extrusion 166 positioned between conductor pair 154 and insulated conductor 170. The profiled outer surfaces of extrusion 166 serve to provide easier termination of the cables therein, and also enhances isolation between the respective insulated conductors 168 and 170 and the high voltage conductor pair 154.

Figure 15:
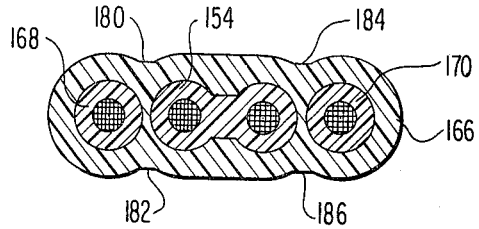
FIG. 15 is a variation of the embodiment of FIG. 14 of the present invention.

Referring now to FIG. 15, an alternate embodiment of the cable of FIG. 14 is presented wherein the reduced thickness portions are defined by substantially flat indented areas 180 and 182 located intermediate insulated conductor 168 and conductor pair 154, and substantially flat indentations 184 and 186 located intermediate conductor pair 154 and insulated conductor 170. Portions 180, 182, 184 and 186 provide an overall thickness of those portions of extrusion 166 between adjacent insulated conductors which may be somewhat less than that provided by the reduced thickness portions of the embodiment of FIG. 14. Clearly, many different profiles and thicknesses may be designed, depending upon the particular degree of isolation desired, as well as other manufacturing and aesthetic considerations.

Figure 16:
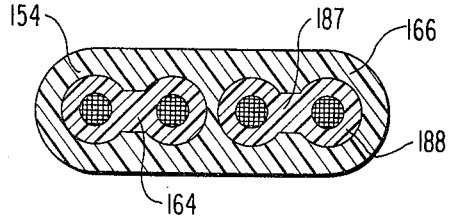
FIG. 16 is another alternate embodiment of the basic telephone cable of FIG. 11.

Referring now to FIG. 16, there is illustrated a cross-section of an extrusion 166 within which is positioned a pair of high voltage conductor pairs 154 and 188. Conductor pair 188 may be substantially identical to conductor pair 154, or the window web 187 thereof may be of increased or reduced thickness when compared with window web 164 for providing less or greater cross-cancellation, respectively, between the conductors in the pair, as may be desired for a particular application.

Figure 17:
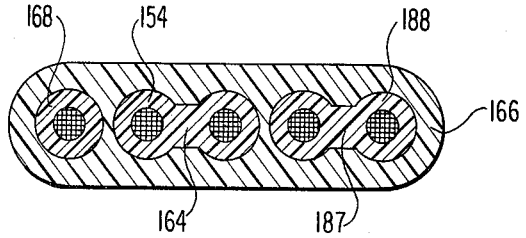
FIGS. 17, 18 and 19 are all cross-sectional views of alternate embodiments of the basic multi-conductor cable of the present invention.

FIG. 17 is similar to FIG. 16 but include an additional insulated conductor 168 whose signal is protected from interference from conductor pairs 154 and 188 by virtue of EMF window webs 164 and 187. Clearly, reduced thickness portions of extrusion 166 may be provided to enhance such isolation, as illustrated above in connection with FIGS. 14 and 15.

Figure 18:
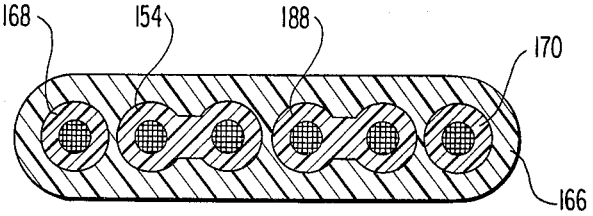

FIG. 18 illustrates a further modification wherein an additional signal-carrying insulated conductor 170 is provided on the opposite side of extrusion 166. Again, profiling of the outer surfaces of extrusion 166 may serve to further enhance isolation and thereby protect the information on conductors 168 and 170.

Figure 19:
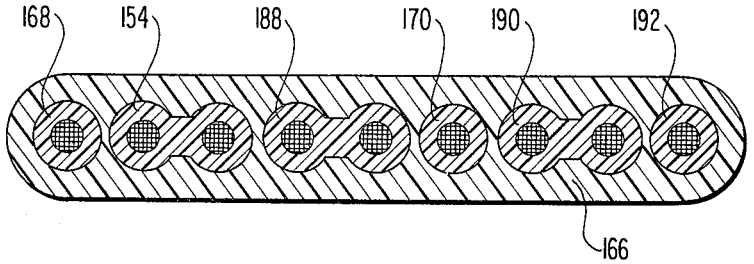

FIG. 19 illustrates yet another embodiment of the present invention wherein an additional high voltage conductor pair 190, and an additional insulated signal-carrying conductor 192 are provided within extrusion 166. This multi-conductor cable has the capability of carrying three sets of high voltage conductor pairs, and three lines of information-carrying signal conductors, while providing a high degree of isolation and minimizing EMF interferences therewithin.

Obviously, numerous modifications and variations of the present invention are possible in light of the above teachings. It is therefore to be understood that within the scope of the appended claims, the invention may be practiced otherwise than as specifically described herein.

I claim as my invention:

1. A multi-conductor cable, which comprises:

a plurality of parallel conductors each enclosed by an insulation having a first velocity of propagation, each such insulated conductor having a substantially circular uniform cross-section along its length;

means for encapsulating said plurality of insulated conductors in a fixed spaced relationship and comprised of a material with a second velocity of propagation different than said first velocity of propagation, said encapsulating means including substantially parallel opposed outer surfaces having portions located adjacent said insulated conductors and portions located intermediate said insulated conductors; and means for controlling the electromagnetic field interaction between adjacent insulated conductors which comprises said portions of said encapsulating means located intermediate said insulated conductors;

wherein said plurality of insulated conductors comprises first, second and third insulated conductors arranged substantially in a plane;

wherein said portion of said encapsulating means located intermediate said first and second insulated conductors has an overall thickness less than that of said portions located adjacent said first and second conductors for providing EMF isolation between said first and second insulated conductors.

2. The cable as set forth in claim 1, wherein said portion of said encapsulating means located intermediate said second and third insulated conductors has an overall thickness greater than that of said portion located intermediate said first and second insulated conductors for providing less EMF isolation between said second and third insulated conductors than that between said first and second insulated conductors.

3. The cable as set forth in claim 2, wherein said overall thickness of said portion of said encapsulating means located intermediate said second and third insulated conductors is substantially the same as that of said portions located respectively adjacent said second and third insulated conductors.

4. The cable as set forth in claim 1, wherein said portion of said encapsulating means located intermediate said second and third insulated conductors has an overall thickness substantially the same as that portion located intermediate said first and second insulated conductors.

5. The cable as set forth in claim 4, further comprising at least two uninsulated screen conductors which are respectively positioned intermediate said first and second insulated conductors and said second and third insulated conductors within said portion of said encapsulating means located intermediate same, respectively.

6. A multi-conductor cable, which comprises:

a plurality of parallel conductors each enclosed by an insulation having a first velocity of propagation, each such insulated conductor having a substantially circular uniform cross-section along its length;

means for encapsulating said plurality of insulated conductors in a fixed spaced relationship and comprised of a material with a second velocity of propagation different than said first velocity of propagation, said encapsulating means including substantially parallel opposed outer surfaces having portions located adjacent said insulated conductors and portions located intermediate said insulated conductors; and means for controlling the electromagnetic field interaction between adjacent insulated conductors which comprises said portions of said encapsulating means located intermediate said insulated conductors;

wherein said plurality of insulated conductors comprises first and second pairs of insulated conductors arranged substantially in a plane;

wherein said portion of said encapsulating means located intermediate said first and second pairs of insulated conductors has an overall thickness less than that of said portions located adjacent said first and second pairs of insulated conductors for providing EMF isolation between said first and second pairs of insulated conductors.

7. The cable as set forth in claim 6, further comprising a third pair of insulated conductors arranged coplanar with said first and second pairs.

8. The cable as set forth in claim 7, wherein said portion of said encapsulating means located intermediate said second and third pairs of insulated conductors has an overall thickness substantially the same as that portion located intermediate said first and second pairs of insulated conductors.

9. The cable as set forth in claim 8, further comprising at least two uninsulated screen conductors which are respectively positioned intermediate said first and second pairs of insulated conductors and said second and third pairs of insulated conductors within said portion of said encapsulating means located intermediate same, respectively.

10. A multi-conductor cable, which comprises:

a plurality of parallel conductors each enclosed by an insulation having a first velocity of propagation, each such insulated conductor having a substantially circular uniform cross-section along its length;

means for encapsulating said plurality of insulated conductors in a fixed spaced relationship and comprised of a material with a second velocity of propagation different than said first velocity of propagation, said encapsulating means including substantially parallel opposed outer surfaces having portions located adjacent said insulated conductors and portions located intermediate said insulated conductors; and a substantially planar EMF window web extending between adjacent insulated conductors and formed integrally with said insulation that encloses said adjacent insulated conductors, the thickness of said web being less than the outer diameter of said insulation;

a first additional insulated conductor coplanar with said adjacent insulated conductors;

a second additional insulated conductor coplanar with said first additional and said adjacent insulated conductors;

wherein said first and second additional insulated conductors are positioned one on each side of said adjacent insulated conductors;

further comprising means for controlling the electromagnetic field interaction between said adjacent insulated conductors and said first and second additional insulated conductors which comprises said portions of said encapsulating means located intermediate said insulated conductors;

wherein said portion of said encapsulating means located intermediate said first additional insulated conductor and said adjacent insulated conductors has an overall thickness less than that of said portions located respectively adjacent said insulated conductors.

11. A cable as set forth in claim 10, wherein the overall thickness of said portion of said encapsulating means located intermediate said second additional insulated conductor and said adjacent insulated conductors in substantially the same as that of said portion located between said first additional insulated conductor and said adjacent insulated conductors.

* * * * *